US009440467B2

(12) United States Patent
Hirabayashi

(10) Patent No.: US 9,440,467 B2
(45) **Date of Patent: *Sep. 13, 2016**

(54) INKJET PRINTER HAVING CONSUMABLE REPLACEMENT OPENINGS

(71) Applicant: SEIKO EPSON CORPORATION, Tokyo (JP)

(72) Inventor: Kenichi Hirabayashi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/830,734

(22) Filed: Aug. 20, 2015

(65) Prior Publication Data

US 2015/0352869 A1 Dec. 10, 2015

Related U.S. Application Data

(63) Continuation of application No. 14/315,467, filed on Jun. 26, 2014, now Pat. No. 9,144,988.

(30) Foreign Application Priority Data

Jun. 28, 2013 (JP) ..... 2013-136042

(51) Int. Cl.

| | |
|---|---|
| ***B41J 2/175*** | (2006.01) |
| ***B41J 29/13*** | (2006.01) |
| ***B41J 2/185*** | (2006.01) |
| ***B41J 29/02*** | (2006.01) |
| ***B41J 2/165*** | (2006.01) |
| ***B41J 2/17*** | (2006.01) |
| ***B41J 11/22*** | (2006.01) |

(52) U.S. Cl.

CPC ..... *B41J 29/02* (2013.01); *B41J 2/16523* (2013.01); *B41J 2/175* (2013.01); *B41J 2/1721* (2013.01); *B41J 2/17503* (2013.01); *B41J 11/22* (2013.01); *B41J 29/13* (2013.01); *B41J 2002/1856* (2013.01)

(58) Field of Classification Search

CPC B41J 2/17503; B41J 2/16523; B41J 2/1721; B41J 2/16532; B41J 2/185

See application file for complete search history.

(56) References Cited

U.S. PATENT DOCUMENTS

| | | | | |
|---|---|---|---|---|
| 7,533,956 | B2 * | 5/2009 | Hatanaka | B41J 2/2107 347/21 |
| 7,971,989 | B2 * | 7/2011 | Sasaki | B41J 15/042 101/235 |
| 7,976,121 | B2 | 7/2011 | Harada | |

(Continued)

FOREIGN PATENT DOCUMENTS

| | | | |
|---|---|---|---|
| JP | 10-181042 | A | 7/1998 |
| JP | 2007-50548 | A | 3/2007 |
| JP | 2007-152811 | A | 6/2007 |

OTHER PUBLICATIONS

U.S. Appl. No. 14/315,467.*

*Primary Examiner* — Matthew Luu
*Assistant Examiner* — Patrick King
(74) *Attorney, Agent, or Firm* — Hauptman Ham, LLP

(57) ABSTRACT

An inkjet printer is provided with a printer front where a paper exit of the printer opens, the printer also having a roll paper replacement opening disposed below the paper exit on a vertical axis, an ink cartridge replacement opening disposed on one side of the roll paper replacement opening on a transverse axis, and a waste ink tank replacement opening disposed on another side of the roll paper replacement opening on the transverse axis.

13 Claims, 7 Drawing Sheets

(56) References Cited

U.S. PATENT DOCUMENTS 9,144,988 B2 * 9/2015 Hirabayashi ..... B41J 2/17503
2007/0035578 A1 2/2007 Suzuki
2007/0126790 A1 6/2007 Sasaki
2011/0227997 A1 9/2011 Sasaki

* cited by examiner

INKJET PRINTER HAVING CONSUMABLE REPLACEMENT OPENINGS

RELATED APPLICATION(S)

The instant invention is a continuation of U.S. patent application Ser. No. 14/315,467 filed Jun. 26, 2015 claims priority to Japanese patent application No. 2013-136042 filed Jun. 28, 2013, the entire disclosure of which is incorporated by reference herein.

BACKGROUND

1. Technical Field

The present disclosure relates to an inkjet printer.

2. Related Art

The inventors have noticed the existence of printers which perform a regular maintenance operation in which ink droplets are ejected from each nozzle in order to prevent the inkjet head from clogging, for example. An inkjet printer with a removable waste ink tank into which the waste ink ejected from the nozzles is described in JP-A-H10-181042.

The inventors have noticed that ink cartridges that are removably installed in some printers as the ink supply source are also used in inkjet printers. The English abstract of JP-A-2007-152811 states in part that a "rolled sheet printer can be made small/compact, since both sides of a rolled sheet storage part remaining as a dead space is utilized effectively."

A replacement opening is formed in the side of the printer case or in the front of the printer case as described in JP-A-2007-152811 in an inkjet printer, and ink cartridges can be accessed from the side or the front of the printer.

The waste ink tank is replaced less frequently than the ink cartridge, and is therefore disposed to an inconspicuous part of the printer case. The waste ink tank is normally located at the side or back of the printer case, or the bottom of the printer case as described in JP-A-H10-181042, and is replaced from the side, the back, or the bottom of the printer case.

SUMMARY

According to some embodiments, An inkjet printer, comprises a printer front located on a front face of the inkjet printer and having a paper exit formed therethrough, a roll paper replacement opening formed in the printer front below the paper exit, an ink cartridge replacement opening formed in the printer front on a first side of the roll paper replacement opening, and a waste ink tank replacement opening formed in the printer front on a second side of the roll paper replacement opening on the transverse axis.

DESCRIPTION OF EMBODIMENTS

Exemplary embodiments of the present disclosure is described below with reference to the accompanying drawings.

Configuration of the Printer Front

Figure 1:
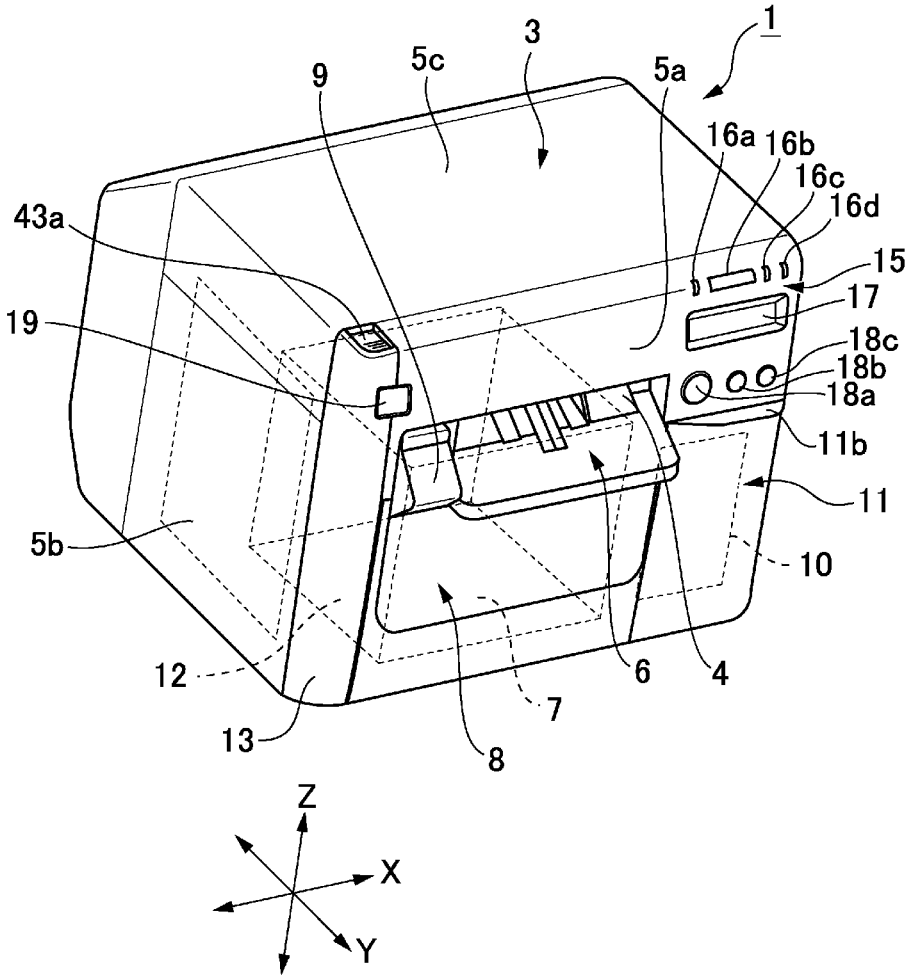
FIG. 1 is a perspective view of an inkjet printer according to at least one embodiment.
Figure 2B:
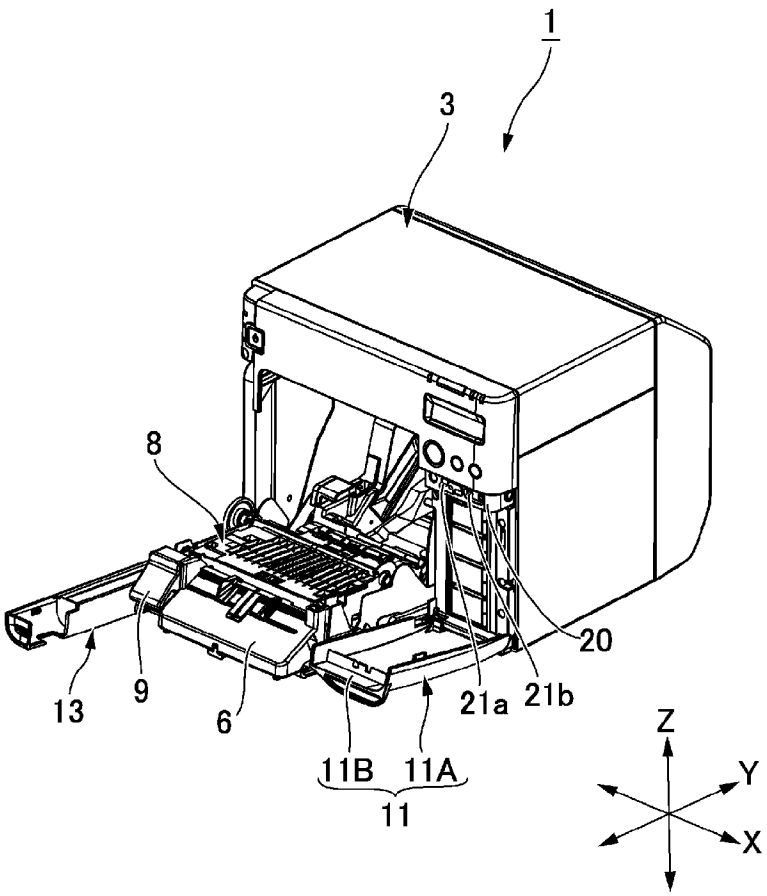
FIG. 2A and FIG. 2B are perspective views of the inkjet printer when the replacement openings are open.
Figure 2A:
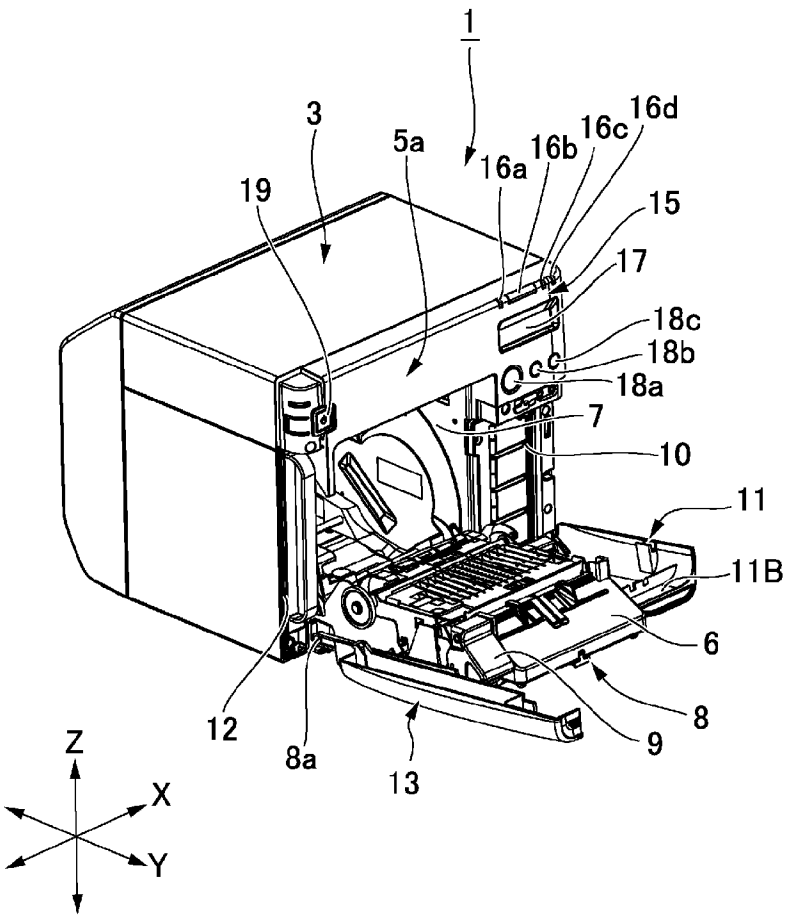
Figure 3B:
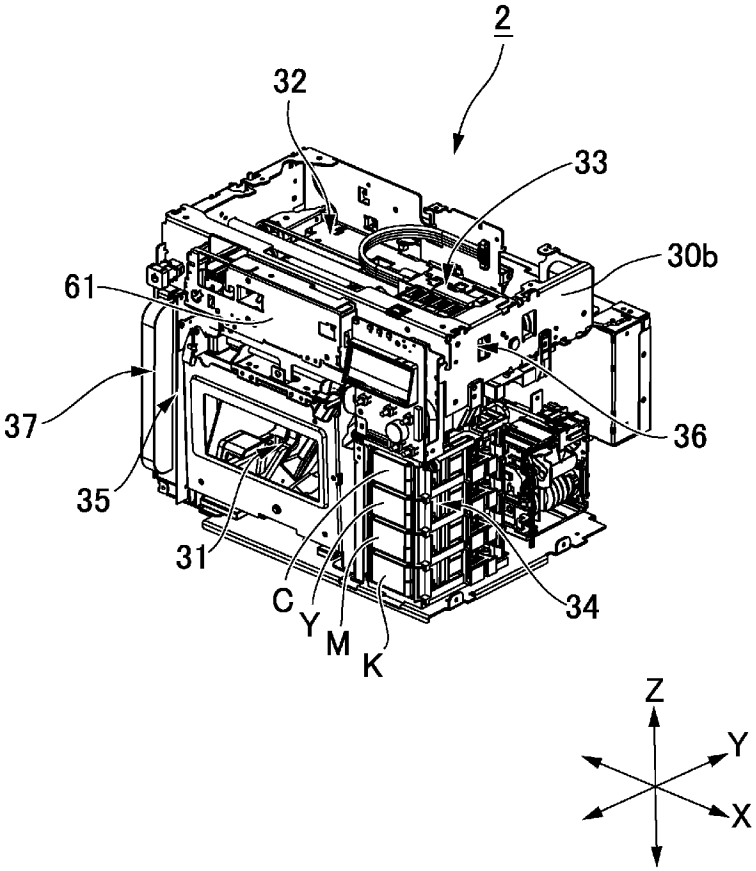
FIG. 3A and FIG. 3B are perspective views showing the print mechanism unit of the inkjet printer.
Figure 3A:
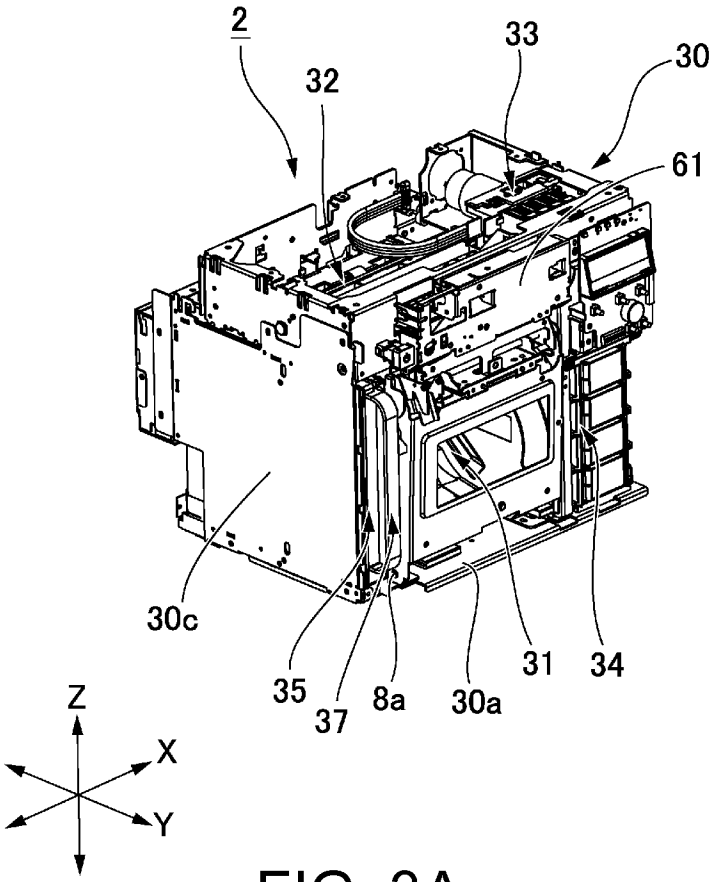

FIG. 1 is a perspective view of an inkjet printer according to one or more embodiments. FIG. 2A is a perspective view from the front left side and FIG. 2B is a perspective view from the front right side of the inkjet printer when the replacement openings in the printer front are open. FIG. 3A is a perspective view from the front left side and FIG. 3B is a perspective view from the front right side of the print mechanism unit of the inkjet printer according to one or more embodiments.

The printer 1 has a paper exit 4 of a specific width, and the side of the printer case 3 through which the paper exit 4 opens is referred to herein as the printer front 5*a*. The paper exit 4 is an opening of a specific width extending on the transverse axis X widthwise to the printer. A paper guide 6 that extends forward from the front is attached to the front of the printer 1 along the bottom edge of the paper exit 4, that is, the bottom edge on the vertical axis Z perpendicular to the transverse axis X.

A rectangular roll paper replacement opening 7 of a specific width and a specific height that can be opened to the printer front 5*a* is formed below the paper exit 4 on the vertical axis Z. The roll paper replacement opening 7 is closed by a roll paper replacement opening cover 8 attached so that it can open and close at the front of the printer 1. The roll paper replacement opening cover 8 can be opened by operating a cover opening lever 9 that unlocks a lock (not shown). The cover opening lever 9 is disposed beside the paper exit 4 on one side (referred to as the second side herein) on the transverse axis X.

The roll paper replacement opening cover 8 can open and close to the front of the printer by pivoting on the bottom end on the vertical axis Z. More specifically, support pins 8*a* (FIG. 3A) extending on the transverse axis X are affixed at the bottom part of the print mechanism unit 2 on the printer front 5*a* side. The roll paper replacement opening cover 8 can pivot on the support pins 8*a* between the closed position shown in FIG. 1 and the open position shown in FIG. 2A where it is substantially horizontal in front of the printer. The paper guide 6 is attached to the roll paper replacement opening cover 8, and the paper exit 4 also opens when the roll paper replacement opening cover 8 opens.

A rectangular ink cartridge replacement opening 10 that is long on the vertical axis Z and can open in the printer front 5*a* is formed on the opposite side (first side) of the roll paper replacement opening 7 as the cover opening lever 9 on the transverse axis X. The ink cartridge replacement opening 10 is closed by a cartridge replacement opening cover 11 attached to the front of the printer 1.

A narrow waste ink tank replacement opening 12 that is long on the vertical axis Z and can open in the printer front 5*a* is formed on the opposite side (second side) of the roll paper replacement opening 7 as the ink cartridge replacement opening 10 on the transverse axis X. The waste ink tank replacement opening 12 is closed by a tank replacement opening cover 13 removably attached to the front of the printer 1.

The paper exit 4, roll paper replacement opening 7, ink cartridge replacement opening 10, and waste ink tank replacement opening 12 in this printer 1 are thus disposed to the printer front 5*a*. Removing recording paper, replacing roll paper, replacing the ink cartridges, and replacing the waste ink tank can therefore be done from the front of the printer. Maintenance tasks other than these replacement tasks can also be done through these replacement openings 7, 10, 12.

An operating panel 15 where an LCD display and plural operating members are located is also disposed at the printer front 5*a*. The operating panel 15 is located above the ink cartridge replacement opening 10 on the vertical axis Z, and beside the paper exit 4 on the transverse axis X (at a position on the first side). A power indicator with internal LED 16*a*, a status indicator 16*b*, a paper-end indicator 16*c*, and an ink-end indicator 16*d* are disposed in order along the transverse axis X in the display unit of the operating panel 15. An LCD screen 17 that is long on the transverse axis X is disposed below the display unit. Multiple operating members, such as a paper cutter drive button 18*a*, paper feed button 18*b*, and cleaning switch 18*c*, are disposed below the LCD screen 17.

A power switch 19 is disposed to the printer front 5*a* on the opposite side (second side) of the paper exit 4 as the operating panel 15. The power switch 19 is disposed to a position at the top part of the boundary between the cover opening lever 9 and the waste ink tank replacement opening 12. The power switch 19 is thus disposed to a position separated on the transverse axis X from the operating panel 15 where other operating members are located. Operating errors such as mistakenly operating the power switch 19 when operating an operating member of the operating panel 15 can therefore be reliably prevented.

As will be understood from FIG. 2A and FIG. 2B, another operating panel 20 is disposed to a position above the ink cartridge replacement opening 10 on the vertical axis Z. Configuration switches including a plurality of DIP (dual in-line package) switches 21*a*, and a button group 21*b* for adjusting the contrast (brightness) of the LCD screen 17, for example, are disposed to the operating panel 20. The top part of the cartridge replacement opening cover 11 is a cover part 11B that covers the operating panel 20, and the remaining part is a cover part 11A that closes the ink cartridge replacement opening 10. As shown in FIG. 1, when the ink cartridge replacement opening 10 is closed by the cartridge replacement opening cover 11, the operating panel 20 is also covered and concealed.

As described above, the display units and operating members used by the user for normal operations are disposed to the printer front 5*a*. The status of the printer 1 can therefore be confirmed and operations can be input from the front of the printer. Configuration switches including the DIP switches 21*a* and button group 21*b* for contrast adjustment that are not commonly used can also be exposed to the printer front by opening the cartridge replacement opening cover 11. These tasks can also be easily completed without moving the printer 1 or accessing the back of the printer 1.

Printer Mechanism Unit

The internal configuration of the printer 1 is described next. The print mechanism unit 2 that is covered by the printer case 3 includes a printer frame 30 comprising a sheet metal bottom 30*a*, and left and right side panels 30*b*, 30*c* as shown in FIG. 3A and FIG. 3B. Other components of the printer 1 are assembled on the printer frame 30.

A roll paper compartment 31 that can open to the printer front through the roll paper replacement opening 7 is disposed in the middle of the print mechanism unit 2 on the transverse axis X. A paper roll (not shown in the figure) comprising a continuous web of label paper or other roll paper wound in a roll is stored on its side inside the roll paper compartment 31.

The recording paper is pulled from the paper roll toward the back on the longitudinal axis Y, through the recording paper conveyance path 32 extending on the longitudinal axis Y above the roll paper compartment 31 to the printer front, and out from the paper exit 4.

A head carriage 33 is disposed so that it can travel bidirectionally along the transverse axis X above the recording paper conveyance path 32. An inkjet head 29 (see FIG. 4 described below) is mounted on the head carriage 33 facing the recording paper conveyance path 32. The head carriage 33 moves through a range extending past the width of the recording paper conveyance path 32 on both sides.

An ink cartridge loading unit 34 that opens to the front of the printer through the ink cartridge replacement opening 10 is disposed on one side (the first side) of the roll paper compartment 31 on the transverse axis X. A waste ink tank loading unit 35 that also opens to the front through the waste ink tank replacement opening 12 is disposed on the opposite side (second side) of the roll paper compartment 31 on the transverse axis X. A head maintenance unit 36 is disposed above the ink cartridge loading unit 34 on the vertical axis Z.

The head carriage 33 can move bidirectionally on a straight path along the transverse axis X at a position above the head maintenance unit 36, the recording paper conveyance path 32, and the waste ink tank loading unit 35 on the vertical axis Z. Note that a paper cutting mechanism 61 (cutter) is also disposed above the paper exit 4 on the vertical axis Z.

The ink cartridge loading unit 34 is a loading unit that extends on the longitudinal axis Y and has a cross section that is longer on the vertical axis Z than the transverse axis X. This ink cartridge loading unit 34 is divided along the vertical axis Z into plural segments. In this example there are four segments for loading ink cartridges K, M, Y, C containing black ink, magenta ink, yellow ink, and cyan ink, respectively, from bottom to top.

The waste ink tank loading unit 35 is longer on the vertical axis Z and the longitudinal axis Y than the transverse axis X. A waste ink tank 37 with a flat, box-like shape is installed standing on its side.

The ink cartridge loading unit 34 and waste ink tank loading unit 35 are thus disposed in at least one embodiment using space within the range of head carriage 33 movement on opposite sides of the roll paper compartment 31. By thus providing sufficient space for the loading units 34, 35, the printer 1 can be made small and compact without increasing the width of the printer 1.

Figure 4:
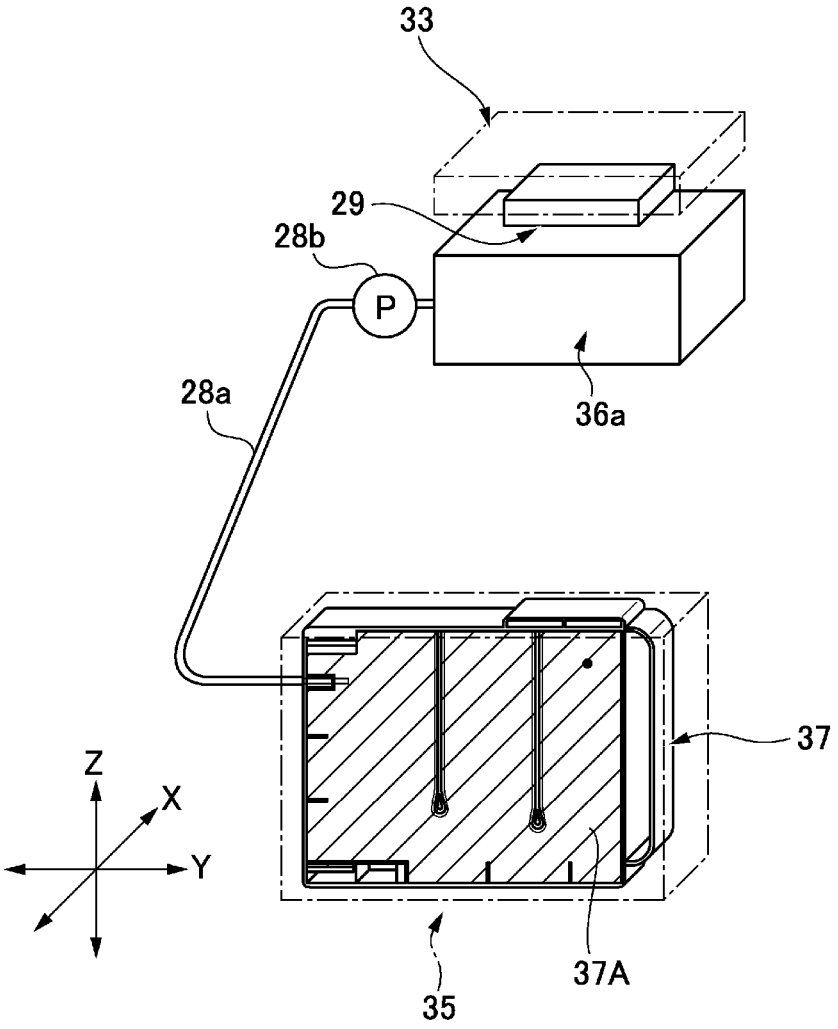
FIG. 4 is a schematic view of a waste ink recovery system.

A waste ink recovery channel for recovering waste ink into the waste ink tank 37 is also configured in the print mechanism unit 2. FIG. 4 illustrates the waste ink recovery channel.

A waste ink tube 28*a* connecting the head maintenance unit 36 to the waste ink tank loading unit 35 is disposed to a position at the back of the print mechanism unit 2. The inkjet head 29 mounted on the head carriage 33 performs an ink droplet ejection operation (flushing) from the nozzles to refresh the nozzles at a position covered by the head cap 36*a* of the head maintenance unit 36. The ejected waste ink is discharged through the waste ink tube 28*a* from the head cap 36*a* of the head maintenance unit 36 by a pressure feed pump 28*b* into the waste ink tank loading unit 35, and recovered into the waste ink tank 37 installed therein. The waste ink tube 28*a* goes substantially straight horizontally on the transverse axis X at the same height on the vertical axis at a position at the back of the printer. The waste ink recovered into the waste ink tank 37 is absorbed and held by a porous absorbent material 37A held inside the waste ink tank 37.

Cartridge Replacement Opening Cover

Figure 5B:
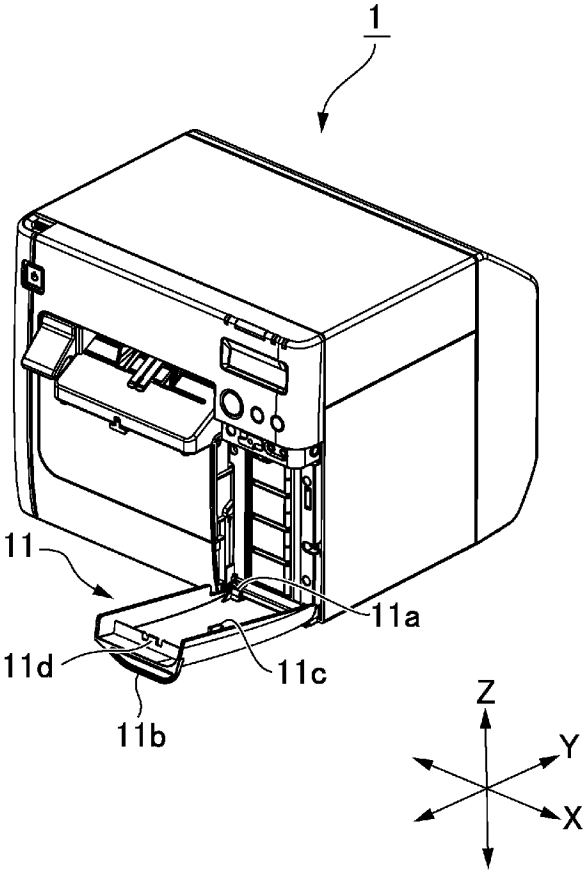
FIG. 5A and FIG. 5B are perspective views of the inkjet printer with the ink cartridge replacement openings open.
Figure 5A:
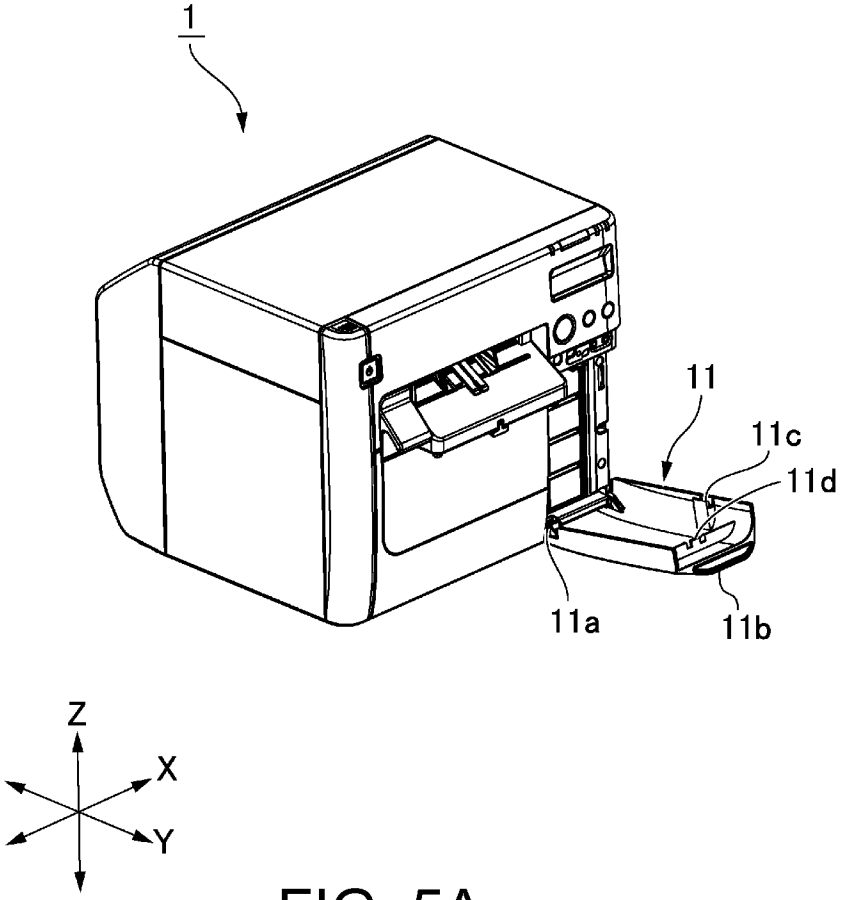

FIG. 5A is a perspective view from the front left side of the printer 1, and FIG. 5B is a perspective view from the front right side of the printer 1, with the cartridge replacement opening cover 11 open.

As shown in these figures, the cartridge replacement opening cover 11 is an openable cover that can open to the printer front pivoting at the bottom on vertical axis Z. More specifically, the cartridge replacement opening cover 11 can pivot on support pins 11*a* affixed at the bottom part of the print mechanism unit 2 and extending on the transverse axis X between the closed position shown in FIG. 1 and the open position shown in FIG. 5A and FIG. 5B where the cartridge replacement opening cover 11 is substantially horizontal in front of the printer.

The cartridge replacement opening cover 11 is a cover with a rectangular contour that is longer on the vertical axis Z thank along axis X, and has a grip 11*b* at the top that can be used to open and close the cover 11. Hooks 11*c*, 11*d* are formed at the side and the top inside surface of the cartridge replacement opening cover 11, and catches (not shown in the figure) that the hooks can catch by elastic deformation are disposed to the printer case 3 at corresponding positions inside the ink cartridge replacement opening 10. When the hooks and catches are engaged, the cartridge replacement opening cover 11 is held in the closed position covering the ink cartridge replacement opening 10. When the grip 11*b* is pulled to the printer front with a certain force, the hooks disengage the catches and the cartridge replacement opening cover 11 can be opened.

The cartridge replacement opening cover 11 can thus pivot at the bottom and open to the front of the printer. There is generally sufficient space in front of the printer. The cartridge replacement opening cover 11 can therefore be opened and closed more easily than when the cartridge replacement opening cover 11 swings to the side to open the ink cartridge replacement opening 10. Ink cartridges can therefore be easily replaced in the ink cartridge loading unit 34.

Tank Replacement Opening Cover

Figure 6B:
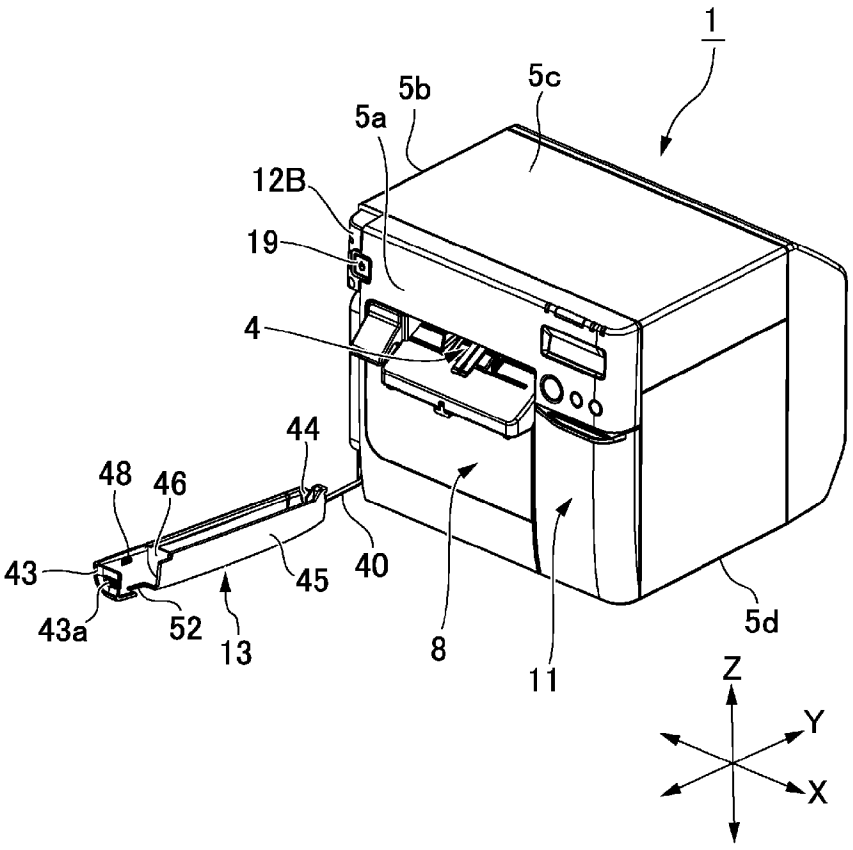
FIG. 6A and FIG. 6B are perspective views of the inkjet printer with the waste ink tank replacement opening open.
Figure 6A:
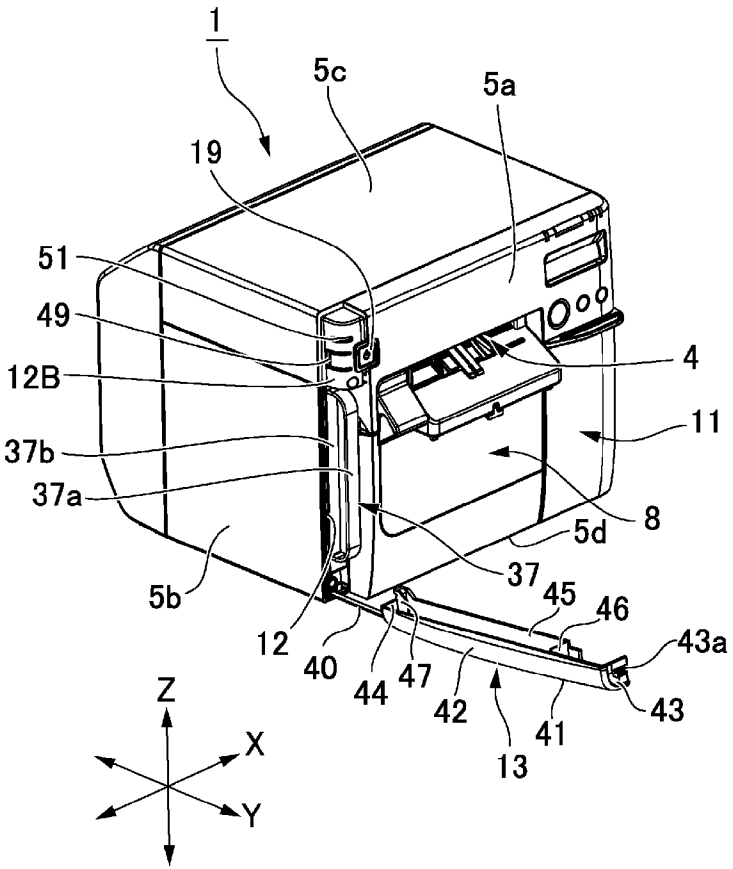

FIG. 6A is a perspective view from the front left side and FIG. 6B is a perspective view from the front right side of an inkjet printer when the tank replacement opening cover 13 is open according to at least one embodiment. FIG. 7A is a perspective view of the tank replacement opening cover 13 when opened to the horizontal position to the printer front according to at least one embodiment, and FIG. 7B is a perspective view of the tank replacement opening cover 13 when upright on the vertical axis Z according to at least one embodiment.

Referring to FIG. 1, FIG. 6A, and FIG. 6B, the tank replacement opening cover 13 is a cover with a length substantially the same as the height of the printer 1 on the vertical axis Z. The tank replacement opening cover 13 is removably installed to the printer front 5*a*. The bottom of the tank replacement opening cover 13 and the bottom edge part of the waste ink tank replacement opening 12 are connected by a connection band 40, which is a flexible connection member. As a result, there is no danger of the tank replacement opening cover 13 while removed from the printer front 5*a* of the printer 1 falling and being damaged. The tank replacement opening cover 13 will also not be lost when removed.

Figure 7B:
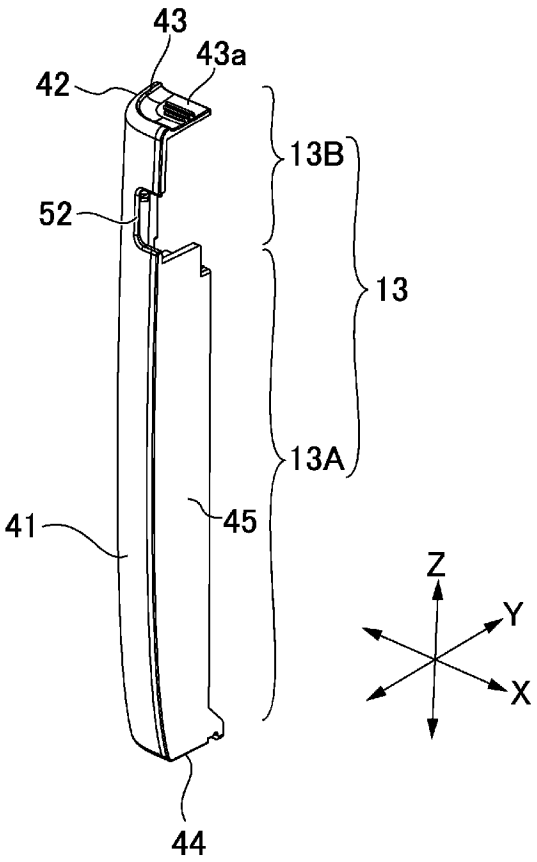
FIG. 7A and FIG. 7B are perspective views of the tank replacement opening cover that closes the waste ink tank replacement opening.
Figure 7A:
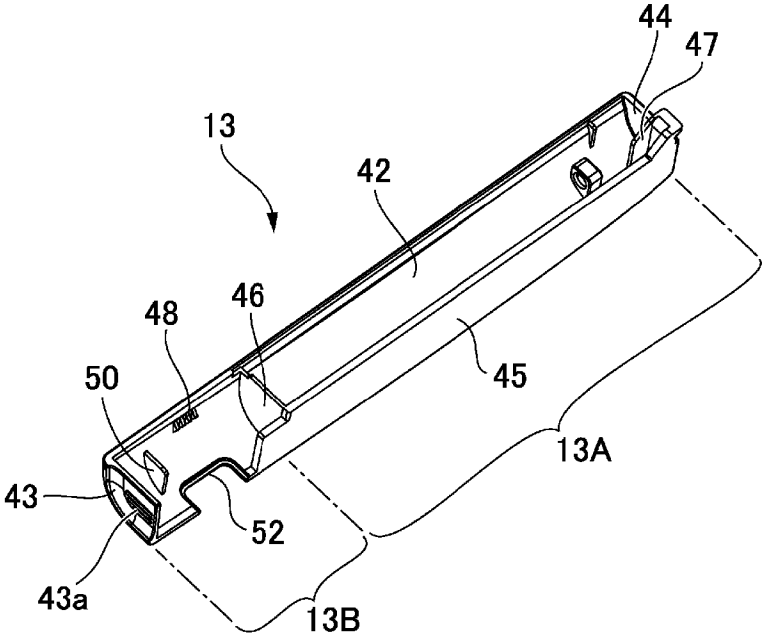

According to at least one embodiment, in FIG. 7B, the tank replacement opening cover 13 includes a cover front 41 facing the printer front 5*a* (5*a* not shown), a side member 42 extending toward the back of the printer from the side of the printer front 5*a* and facing the printer side 5*b* (5*b* not shown), a top member 43 facing the printer top 5*c* (5*c* not shown), and a bottom member 44 facing the printer bottom 5*d* (5*d* not shown). A vertical divider 45 is also formed extending toward the printer back from the edge of the front member 41 of the tank replacement opening cover 13 on the roll paper replacement opening cover 8 side. In FIG. 7A a horizontal divider 46 is also formed inside the tank replacement opening cover 13 near the top. The portion below the horizontal divider 46 is the cover portion 13A that closes the waste ink tank replacement opening 12. The portion above the horizontal divider 46 is a top cover portion 13B that covers the gap in the printer front 5*a* (5*a* not shown) between the top of the waste ink tank replacement opening 12 and the printer top 5*c* (5*c* not shown). A rectangular notch 52 corresponding to the contour of the power switch 19 (power switch 19 not shown) is formed in the cover portion 13B.

A positioning member such as a positioning tab 47 is also formed at the bottom inside the tank replacement opening cover 13. A latch hook 48 is also formed to the tank replacement opening cover 13. A rounded surface 12B is formed above the waste ink tank replacement opening 12 on the printer front 5*a* side of the printer 1 as shown in FIG. 6A, and a channel 49 that can engage the hook 48 by elastic deformation is formed at a position corresponding to the hook 48. When the tank replacement opening cover 13 is positioned and pushed into the waste ink tank replacement opening 12 at the printer front 5*a*, the hook 48 engages the channel 49, the tank replacement opening cover 13 is affixed to the printer front 5*a*, and the waste ink tank replacement opening 12 is closed. The rounded surface 12B above the waste ink tank replacement opening 12 is also covered and concealed by the top cover portion 13B of the tank replacement opening cover 13.

A cover detection tab 50 is also formed to the inside surface of the top cover portion 13B of the tank replacement opening cover 13. A slot 51 in which the cover detection tab 50 can enter is formed in the rounded surface 12B of the printer front 5*a*. A detector (not shown in the figure) that can detect the cover detection tab 50 is disposed inside the slot 51. This detector could be a contactless detector such as a photodetector, or a contact detector such as a microswitch. When the tank replacement opening cover 13 is installed to the waste ink tank replacement opening 12, the cover detection tab 50 is inserted to the slot 51, and the cover detection tab 50 is detected by the internal detector. The printer 1 can therefore know whether the tank replacement opening cover 13 is installed or not.

A grip 43*a* is also disposed to the top member 43 of the tank replacement opening cover 13. The grip 43*a* is lower than the printer top 5*c*, and has ridges, for example, for increased friction. To remove the tank replacement opening cover 13 from the printer front 5*a*, the user can simply hold the grip 43*a*, which is at a lower position than the printer top 5*c*, and pull the tank replacement opening cover 13 forward from the printer. The hook 48 therefore disengages the channel 49, and the tank replacement opening cover 13 can be removed forward from the printer front 5*a*.

When the printer 1 is installed on a low shelf, the top member 43 of the tank replacement opening cover 13 can be easily gripped with a finger from the front of the printer even if other objects are set on the top 5*c* of the printer 1. The tank replacement opening cover 13 can therefore be easily removed without moving the printer 1 and without moving other objects.

The tank replacement opening cover 13 also has a front member 41 and a side member 42. Therefore, when the tank replacement opening cover 13 is removed from the printer front 5*a*, the waste ink tank replacement opening 12 is open to the front of the printer and to the side. The waste ink tank 37 that is installed to the waste ink tank loading unit 35 through the waste ink tank replacement opening 12 also has a recessed grip 37*b* formed at the end 37*a* on the side toward the front of the printer. The recessed grip 37*b* is open to the side 5*b*, and is exposed to the side of the printer when the tank replacement opening cover 13 is removed as shown in FIG. 6A.

The waste ink tank 37 can therefore be easily pulled out from the front of the printer from the waste ink tank loading unit 35 by holding and pulling on the recessed grip 37*b*. More specifically, when multiple printers 1 are used arrayed side by side with no space therebetween in the related art, it can be difficult to insert fingers from the waste ink tank replacement opening 12 opened to the printer front, and grip and remove the waste ink tank 37 from the front end. However, because at least this one embodiment of the disclosure enables easily gripping the recessed grip 37*b* exposed to the side at the front end of the waste ink tank 37, the waste ink tank 37 can be easily gripped and pulled out from the front even when the printers 1 are arranged side by side with no space therebetween.

The inventors have noticed that a position of the ink cartridge replacement opening relative to the waste ink tank replacement opening has not been addressed in the related art. For example, if the replacement openings are on different sides of the printer case, the directions in which the ink cartridges or waste ink tank are installed and removed differ.

Assuring sufficient work space on the sides, top, and back of the inkjet printer is also often difficult when the inkjet printer is placed and used on a shelf or other confined location. As a result, when the ink cartridge or waste ink tank replacement opening is on the side, top, or back of the printer case, the inkjet printer is often moved to where there is more work space in order to replace an ink cartridge or the waste ink tank, and this is, in some situations, inconvenient for the user.

In addition, when multiple inkjet printers are disposed and used side by side, the inkjet printers are arranged with very little space in between. There is, therefore, effectively no space on the sides of the inkjet printers. Replacing the waste ink tank or ink cartridge from the side in this configuration also involves moving the inkjet printer, and is inconvenient in some situations.

In some embodiments, removing printed recording paper discharged from the paper exit, replacing the roll paper, replacing ink cartridges, and replacing the waste ink tank can all be done from the front of the printer. An inkjet printer that is easy for the user to use can therefore be provided.

In some embodiments, a serial inkjet printer in which the inkjet head travels back and forth in the transverse direction to print on roll paper, movement of the carriage that carries the inkjet head is greater on both left and right sides than the width of the roll paper compartment. This creates dead space on both sides of the roll paper compartment. When the inkjet head is wide, e.g., with four nozzle rows for cyan, magenta, yellow, and black ink side by side in the direction of travel, a large dead space is easily created on both sides of the roll paper compartment. According to some embodiments, an ink cartridge loading unit including the ink cartridge replacement opening can be located on one side of the roll paper compartment, and the waste ink tank loading unit including the waste ink tank replacement opening can be located on the other side. A small, compact inkjet printer can therefore be achieved by using this dead space to locate the ink cartridge loading unit and the waste ink tank loading unit.

An inkjet printer according to some embodiments also has a roll paper replacement opening cover that is attached openably to the printer front and closes the roll paper replacement opening, a cartridge replacement opening cover that is attached openably or removably to the printer front and closes the ink cartridge replacement opening, and a tank replacement opening cover that is attached openably or removably to the printer front and closes the waste ink tank replacement opening.

Further, in some embodiments, the cartridge replacement opening cover, which covers the ink cartridges that are replaced more frequently than the waste ink tank, is attached to the printer front pivotably forward from the printer front on a pivot axis on the transverse axis at the bottom end of the vertical axis, which is perpendicular to the transverse axis.

There is usually plenty of open space in front of the printer. In some embodiments, the ink cartridges can therefore be easily replaced by using a configuration in which the cartridge replacement opening cover pivots forward to open.

The waste ink tank is replaced less frequently than ink cartridges. An inkjet printer according to some embodiments also has a tank replacement opening cover that is attached openably to the printer front and closes the waste ink tank replacement opening, and a flexible connecting member of a specific length connecting the tank replacement opening cover to the bottom of the waste ink tank replacement opening.

In some inkjet printer configurations, the waste ink tank is a generally flat, box-like configuration, the waste ink tank replacement opening is also a vertically long rectangle, and the tank replacement opening cover is also a long rectangle. When the bottom of the tall tank replacement opening cover is attached to rotate forward in this configuration, strong force is applied to the connection when a sideways force is applied to the tank replacement opening cover, and the connection can easily break. Some embodiments of the present disclosure can avoid this problem by using a removable tank replacement opening cover.

In some embodiments, the removed tank replacement opening cover is connected to the front of the printer, that is, to the bottom of the waste ink tank replacement opening, by a flexible connecting member. There is therefore no danger of the removed tank replacement opening cover falling and breaking. The removed tank replacement opening cover will also not be lost.

According to some embodiments, the inkjet printer also has a tank replacement opening cover that is attached openably to the printer front and closes the waste ink tank replacement opening, the tank replacement opening cover including a front cover part facing the printer front, and a top cover part facing the printer top, and the top cover part has a gripping surface formed at a position lower than the printer top.

To remove a removable tank replacement opening cover from the printer front, the tank replacement opening cover is gripped. In some embodiments, the tank replacement opening cover is formed with a top member, and a gripping surface is formed to this top member at a position lower than the top of the printer in the disclosure. The tank replacement opening cover can be configured more simply than when a handle or other protrusion is formed on the surface of the tank replacement opening cover for gripping. Because the gripping surface of this top member is lower than the top of the printer, the gripping surface can be easily held and the tank replacement opening cover opened from the front of the printer even when there is no space above the printer.

According to some embodiments, the inkjet printer of the disclosure also has a tank replacement opening cover that is attached openably to the printer front and closes the waste ink tank replacement opening. The tank replacement opening cover includes a front cover part facing the printer front, and a side cover part facing the printer side and continuing to the edge of the printer front on the second side, and the waste ink tank replacement opening opens to the printer front and to the printer side when the tank replacement opening cover is removed from the printer front. A waste ink tank, which is inserted from the waste ink tank replacement opening, has a grip member disposed to a position opposing the part of the waste ink tank replacement opening that opens to the printer side.

Because the waste ink tank replacement opening also opens to the side of the printer when the tank replacement opening cover is removed in accordance with some embodiments, the waste ink tank can be easily pulled out to the front by holding the grip of the waste ink tank exposed in the replacement opening. The waste ink tank can therefore be easily removed.

According to some embodiments, the inkjet printer of the disclosure also has an operating panel including a display unit and an operating member and a power switch. The operating panel is disposed to the printer front at a position above the ink cartridge replacement opening on the vertical axis on the first side of the paper exit on the transverse axis, and the power switch is disposed to the printer front at a position above the waste ink tank replacement opening on the vertical axis on the second side of the paper exit on the transverse axis.

In some embodiments, by providing the operating panel with an LCD or other display unit and operating members such as switches and buttons to the front of the printer, content displayed on the display panel can be read and input operations can be easily done from the front of the printer in addition to such tasks as replacing ink cartridges. An inkjet printer with outstanding ease of use for the user can therefore be provided.

In some embodiments, the power switch is also located at the printer front at a position separated from the other switches, buttons, and operating members. Problems such as mistakenly operating the power switch when operating other switches on the operating panel while the printer is operating, and accidentally interrupting printing, can therefore be reliably prevented.

According to some embodiments, the inkjet printer of the disclosure also has a cartridge replacement opening cover that is attached openably or removably to the printer front and closes the ink cartridge replacement opening, and an operating member for printer setup disposed to a printer side face that is exposed when the cartridge replacement opening cover opens.

DIP switches or other operators for printer configuration are generally located on the back or bottom of the printer according to some embodiments. This arrangement is convenient because such switches can be operated from the front of the printer. These switches are located inside the cartridge replacement opening cover, and are normally hidden from view. Because such switches are usually not used, being located inside the cartridge replacement opening cover does not inconvenience the user. Mistaken operation can also be prevented.

When the paper exit, roll paper replacement opening, ink cartridge replacement opening, and waste ink tank replacement opening are located at the front of the printer as described above, parts inside the printer can be configured as described below according to some embodiments.

An inkjet printer according to at least one embodiment also has a recording paper conveyance path that connects to the paper exit, a roll paper compartment disposed below the recording paper conveyance path and including the roll paper replacement opening, an ink cartridge loading unit disposed on the first side of the roll paper compartment on the transverse axis, and including the ink cartridge replacement opening. A waste ink tank loading unit is disposed on the second side of the roll paper compartment on the transverse axis, and includes the waste ink tank replacement opening. A head maintenance unit is disposed above the ink cartridge loading unit on the vertical axis perpendicular to the transverse axis. A head carriage is arranged to move bidirectionally on the transverse axis at a position above the head maintenance unit, recording paper conveyance path, and waste ink tank loading unit on the vertical axis, and has an inkjet head mounted on the head carriage.

According to some embodiments, the ink cartridge loading unit is longer vertically than transversely, and is segmented vertically into a plurality of ink cartridge loading units. The waste ink tank loading unit is longer vertically and longitudinally than transversely, and a waste ink tank with a flat rectangular box shape is installed thereto standing upright.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An inkjet printer, comprising:

a paper exit formed on a front face of the inkjet printer;

a roll paper replacement opening cover that is attached to the front face of the inkjet printer and is configured to open in the direction of the paper exit;

a cartridge replacement opening cover that is attached to the front face of the inkjet printer and is configured to open in the direction of the paper exit; and a waste ink tank replacement opening cover that is attached to the front face of the inkjet printer and is configured to open in the direction of the paper exit.

2. The inkjet printer of claim 1, further comprising:

the roll paper replacement opening cover has a lever configured to open the roll paper replacement opening cover;

the cartridge replacement opening cover has a grip configured to open the cartridge replacement opening cover; and the waste ink tank replacement opening cover has a gripping surface configured to open the waste ink tank replacement opening cover.

3. The inkjet printer of claim 2, wherein:

the lever, the grip and the gripping surface are operable from the front face of the inkjet printer.

4. The inkjet printer of claim 2, wherein:

the roll paper replacement opening cover is configured to be opened by operating the lever.

5. The inkjet printer of claim 1, further comprising:

an operating panel having a display unit and an operating member; and a power switch;

wherein the operating panel and the power switch are disposed to the front face of the inkjet printer.

6. The inkjet printer of claim 1, further comprising:

a recording paper conveyance path connected to the paper exit;

a roll paper compartment disposed below the recording paper conveyance path and comprising the roll paper replacement opening;

an ink cartridge loading unit disposed on the first side of the roll paper compartment, and comprising the ink cartridge replacement opening;

a waste ink tank loading unit disposed on the second side of the roll paper compartment, and comprising the waste ink tank replacement opening;

a head maintenance unit disposed above the ink cartridge loading unit;

a head carriage configured to move bidirectionally along a transverse axis at a position above the head maintenance unit, the recording paper conveyance path, and the waste ink tank loading unit; and an inkjet head mounted on the head carriage.

7. The inkjet printer of claim 6, wherein the first side is opposite to the second side along the transverse axis.

8. The inkjet printer of claim 2, further comprising:

a lock, wherein operation of the lever unlocks the lock.

9. The inkjet printer of claim 1, further comprising:

a cover opening lever; and a lock, wherein the roll paper replacement opening cover is opened by operating the cover opening lever to unlock the lock.

10. The inkjet printer of claim 1, wherein:

the roll paper replacement opening cover, the cartridge replacement opening cover, and the waste ink tank replacement opening cover are on the same side of a transverse axis of the inkjet printer.

11. The inkjet printer of claim 1, wherein:

the roll paper replacement opening cover, the cartridge replacement opening cover, and the waste ink tank replacement opening cover are on the same side of the inkjet printer.

12. The inkjet printer of claim 1, wherein:

the roll paper replacement opening cover, the cartridge replacement opening cover, and the waste ink tank replacement opening cover are on the same side of the inkjet printer when viewed looking towards a front of the printer.

13. The inkjet printer of claim 1, wherein:

the roll paper replacement opening cover, the cartridge replacement opening cover, and the waste ink tank replacement opening cover are on the same side of the inkjet printer when viewed looking towards a front of the printer and when looking towards a side of the printer.

* * * * *